US005882806A

United States Patent [19]

Mori

[11] Patent Number: 5,882,806

[45] **Date of Patent: *Mar. 16, 1999**

[54] ELECTROLUMINESCENT ELEMENT AND METHOD FOR FABRICATING THE SAME

[75] Inventor: Naoyuki Mori, Shiga, Japan

[73] Assignee: NEC Corporation, Tokyo, Japan

[ * ] Notice: The term of this patent shall not extend beyond the expiration date of Pat. No. 5,469,019.

[21] Appl. No.: 514,087

[22] Filed: Aug. 11, 1995

[30] Foreign Application Priority Data

Aug. 12, 1994 [JP] Japan ..... 6-190217

[51] Int. Cl.[6] ..... H05B 33/00

[52] U.S. Cl. ..... 428/690; 428/691; 428/917; 428/421; 313/504

[58] Field of Search ..... 428/690, 917, 428/421, 691; 313/504

[56] References Cited

U.S. PATENT DOCUMENTS 5,469,019 11/1995 Mori ..... 313/509

5,491,377 2/1996 Janusauskas ..... 313/506

FOREIGN PATENT DOCUMENTS 2-276193 11/1990 Japan .

5-26720 7/1993 Japan .

5262720 7/1993 Japan .

*Primary Examiner*—Charles Nold

*Attorney, Agent, or Firm*—Young & Thompson

[57] ABSTRACT

An electroluminescent element is disclosed in which a luminescent layer is formed on a reflective insulating layer coated on a back electrode. The luminescent layer is made of moisture-proof coated phosphor powder distributed in a fluorinated resin such that the phosphor powder is entirely covered with the fluorinated resin. A transparent electrode is bonded to a top surface of the luminescent layer where the phosphor particles are not exposed.

2 Claims, 2 Drawing Sheets

ELECTROLUMINESCENT ELEMENT AND METHOD FOR FABRICATING THE SAME

BACKGROUND OF THE INVENTION

1. Field of the Invention

The present invention relates to an electroluminescent element and a method for fabricating the same, and more particularly, to an electroluminescent element eliminating the moisture-proof films and a method for fabricating the same.

2. Description of the Prior Art

The conventional electroluminescent element 20 has an electroluminescent laminated portion 27 as shown in FIG. 4. The laminated portion 27 which has a substantially rectangular plane shape is hermetically sealed with covering films 28 and 29 having moisture-proof property such as fluorinated resin.

The electroluminescent laminated portion 27 is formed by laminating a reflective insulating layer 22, a luminescent layer 23 and a transparent electrode 24 on a back electrode 21 successively. The reflective insulating layer 22 is formed by dispersing barium titanate or the like in a binder such as cyanoethyl cellulose or cyanoethyl pullulan. The luminescent layer 23 is formed by dispersing zinc sulfide phosphor particles in a similar binder. That top and bottom of the electroluminescent laminated portion 27 are coated with moisture-proof layers 25 and 26 consisting of moisture-proof films.

However, the electroluminescent element is susceptible under high humidity to the blackening of the phosphor or an increase in the dielectric constant caused by the infiltration of moisture into the interior of the laminated portion 27. For these reasons, it requires moisture-proof films consisting of expensive polychlorotrifluoroethylene or the like and a moisture-absorbing film 6 such as nylon, which results in a very high price of the electroluminescent element itself, and gives rise moreover to such problems as the necessity for securing a margin for sealing, imposition of tight restrictions on the effective luminescent part, difficulty in the reduction of the thickness and the like.

Under these circumstances, there has been proposed an electroluminescent element 30 dispensing with moisture-proof films, having such a structure, as shown in FIG. 5, in which a luminescent layer 32 formed by dispersing in fluorinated resin phosphor particles subjected to moisture-proofing treatment and a reflective insulating layer 33 formed by dispersing the powder of an insulator, such as barium titanate, in a fluorinated resin are formed sequentially by screen printing on a transparent electrode 31. Then a back electrode 34 is printed on the reflective insulating layer 33 and an insulating layer 35 is coated on top of it.

However, since the various layers on the transparent conductive film 31 in such a structure are formed by using screen printing process, there is a flaw in the flatness and the quality of the luminescence is not quite satisfactory. For these reasons, there arises the necessity of forming an undercoating layer consisting of cyanoethyl-pullulan between the transparent electrode and the luminescent layer, as disclosed in Japanese Utility Model Publication No. 5-26720 (1993), and pin-holes tend to be generated in the luminescent layer and the insulating layer which becomes the cause of deterioration in the breakdown voltage, as mentioned in Japanese Unexamined Patent Publication (Kokai) No. 2-276193 (1990). Therefore, there exist such problems as an increase in the manhours for flattening treatment to improve the reliability, nonuniformity in the luminescence due to inhomogeneity or nonuniformity of the printed films, difficulty in making the device large-sized, and the like. In addition, because of the screen printing adopted, it is necessary to repeat printing process to obtain a prescribed thickness, making the mass production difficult. Furthermore, because of the high weight ratio more than six of the phosphor to fluorinated resin, there is a problem in that luminescent layer has poor adhesion to the transparent electrode and tends to breaks away from the electrode.

SUMMARY OF THE INVENTION

It is a first object of this invention to provide a high quality electroluminescent element, and a manufacturing method thereof.

It is a second object of this invention to provide a high yield and mass produceable electroluminescent element which is easy to manufacture at low cost, and a manufacturing method thereof.

It is a third object of this invention to provide a thin electroluminescent element which is highly resistant to moisture and has a high breakdown voltage while maintaining high quality, and a manufacturing method thereof.

It is a fourth object of this invention to provide an electroluminescent element with improved adhesion between the transparent electrode and the luminescent layer, and a manufacturing method thereof.

It is a fifth object of this invention to provide an electroluminescent element with improved quality such as reduction in expansion and contraction of the members, improved dimensional precision, reduction in the number of cracks, uniform luminescence and the like, and a manufacturing method thereof.

In order to achieve the above objects, the electroluminescent element according to this invention has a reflective insulating layer formed on the back electrode and a luminescent layer on top of it is formed in such a way that the phosphor powder in a fluorinated resin layer are distributed toward the side of the reflective insulating layer without being exposed on the surface. A transparent electrode is stuck to the surface of the luminescent layer where phosphor particles are not exposed.

When fluorinated rubber is adopted in particular from among the fluorinated resins, since the phsophor particles can be made to be exposed on the surface of the luminescent layer immediately after the printing and the blocking property (the property that the surface has the adhesion) of the luminescent layer can be relaxed by setting the weight ratio of the phosphor to the fluorinated rubber to be more than 1 and less than 5, a roll-to-roll continuous long-sized printing by doctor printing process becomes possible. When a transparent electrode is thermocompression bonded on the luminescent layer, the phosphor particles are pushed against the bottom part of the fluorinated resin layer and are arrayed there, so that the surface of the luminescent layer is exclusively occupied by the fluorinated resin and can be stuck firmly to the transparent electrode, improving the moisture-proof property.

In the electroluminescent element according to this invention, the phosphor particles in the luminescent layer are located biased toward the side opposite to the transparent electrode so that it is possible to drastically improve the adhesion between the luminescent layer and the transparent electrode.

BRIEF DESCRIPTION OF THE DRAWINGS

The above-mentioned and other objects, features and advantages of the present invention will become more apparent from the following detailed description when taken in conjunction with the accompanying drawings, wherein.

DESCRIPTION OF THE PREFERRED EMBODIMENTS

Figure 1:
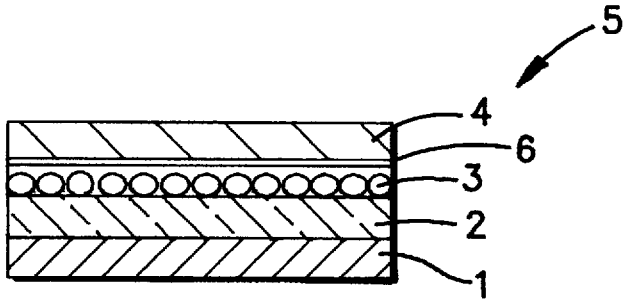
FIG. 1 is a sectional illustrative view of an electroluminescent element according to a first embodiment of the present invention.

An electroluminescent element 5 according to the present embodiment has a structure as shown in FIG. 1. First, a reflective insulating layer 2 in which the powder of an insulator such as barium titanate are dispersed in a fluorinated rubber (for example, G801 fabricated by Daikin Industrial Co., Ltd.) which is a binder, is formed on a back electrode 1 consisting of, for example, an aluminum foil by a continuous doctor printing process. Next, a luminescent layer 3 obtained by dispersing phosphor powder (for example, Sylvania phosphor Type 20), obtained by subjecting phosphor particles of zinc sulfide activated by copper for moisture proofing, in a fluorinated rubber (for example, G801 fabricated by Daikin Industrial Co., Ltd.) film is formed on the reflective insulating layer 2 by using a continuous doctor printing process.

The phosphor particles used have mean grain size of about 20 to 30 μm. Finally a transparent electrode film 4 obtained by forming an indium-tin-oxide (ITO) film 6 on a transparent film, such as a polyethylene terephthalate (PET) film, is stuck with its ITO film side to the luminescent layer 3 by thermocompression bonding process using a laminate or the like, completing the electroluminescent element 5.

Figure 2A:
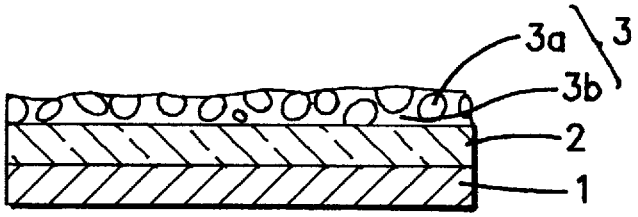
FIG. 2(*a*) and (*b*) are sectional illustrative views of respective steps of a method according to the present invention for describing an adhesion mechanism of a transparent electrode and a luminescent layer according to the present invention, where FIG. 2(*a*) shows a luminescent layer immediately after printing and FIG. 2(*a*) shows the vicinity of an interface between a transparent electrode and a luminescent layer after thermal compression bonding.
Figure 2B:
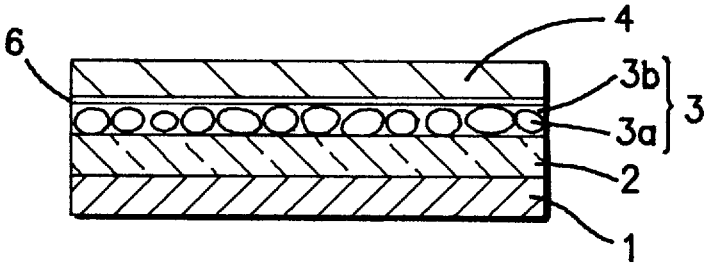
Figure 3:
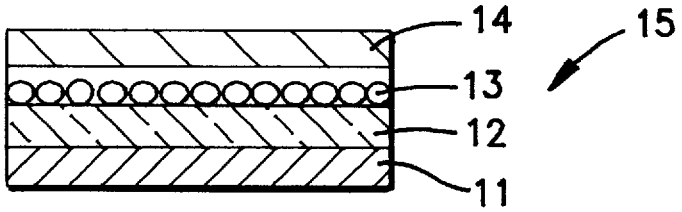
FIG. 3 is a sectional illustrative view of an electroluminescent element according to a second embodiment of the present invention.
Figure 4:
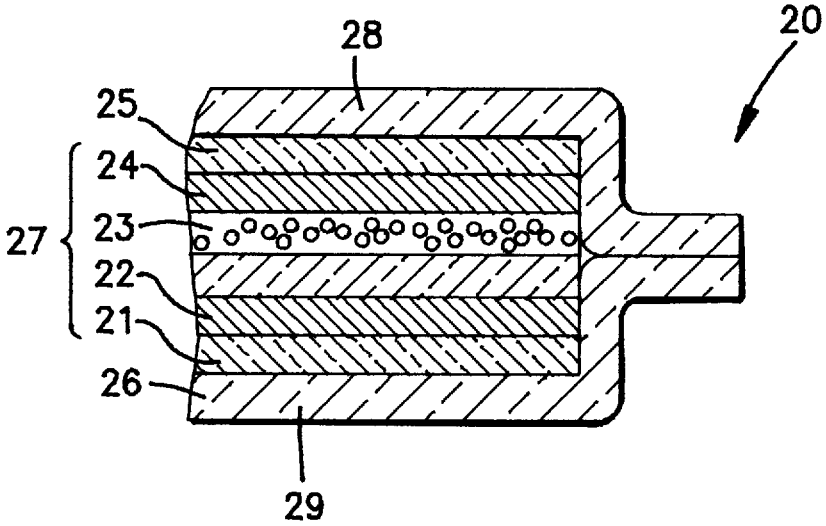
FIG. 4 PRIOR ART
FIG. 4 is an enlarged sectional view of the important part of an electroluminescent element according to a prior art.
Figure 5:
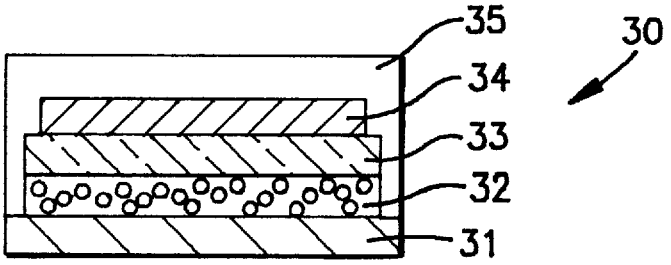
FIG. 5 PRIOR ART
FIG. 5 is a sectional view of an electroluminescent element according to another prior art.

The fluorinated rubber (G801) itself used for the luminescent layer 3 has in general the blocking property at the normal temperature, so that is presents a problem in the actual manufacturing work. However, by setting the weight ratio of the phosphor to the fluorinated rubber to be in the range of 1 to 5, preferably 3 to 4, and the film thickness to the range of 30 to 60 μm, at the normal temperature, the phosphor particles 3*a* are dispersed in fluorinated rubber 3*b* in the luminescent layer 3 after the printing, and the phosphor particles 3*a* are exposed on the surface of the fluorinated rubber 3*b*, as shown in FIG. 2(*a*). Because of this, the surface of the luminescent layer has hardly any blocking property, and even when the reflective insulating layer, the luminescent layer and the like are continuously printed roll-to-roll on a aluminum base and wound in the form of a roll, the surface of the aluminum base and the luminescent layer will not stick with each other, and will not cause such a problem as the peeling of the luminescent layer when the base is taken out from the roll.

Moreover, at the time of thermocompression bonding process for the transparent electrode onto the luminescent layer, the fluorinated rubber 3*b* has an appropriate fluidity in the temperature range of 140° to 200° C., and further, the phosphor particles 3*a* are arrayed by being pushed to the side of the insulating layer 2 by the application of a pressure, so that there is formed a layer of fluorinated rubber in which the fluorinated rubber is pushed out to the side of the surface of the luminescent layer 3 with no exposure of the phosphor particles, as shown in FIG. 2(*b*). So the phosphor particles are distributed toward the insulating layer 2 to avoid the phospher particles contacting with the transparent electrode 6. Since the fluorinated rubber layer is solidified by the cooling process after the passage of the laminator roll, the transparent electrode film 4 and the luminescent layer 3 are readily and firmly stuck with each other, and thus moisture-proof property can be improved. Further, since the fluorinated rubber film has a low moisture absorption and a high dielectric constant, it is possible, by combining it with phosphor particles with moisture-proof coating, to prevent the blackening of the phosphor particles and an increase in the dielectric constant due to infiltration of the moisture into the interior of the element, under high humidity, without the use of the moisture-proof films and moisture-absorbing films. Therefore, the formation of the reflective insulating layer and the luminescent layer by continuous printing and the bonding of the luminescent layer and the transparent conductive film can be achieved, and a highly moisture-proof electroluminescent element can be fabricated at low cost.

Moreover, the quality of luminescence can drastically be improved by the flat formation of the luminescent layer by using thermocompression bonding process which causes the uniform forced array of the phosphor particles. Furthermore, in contrast to the conventional screen printing, a flat thick layer of about 50 μm can be formed in one operation of doctor printing process so that the method is adapted to mass production, and a flat and compact film free from pinholes can be formed so that it will not give rise to the problem of insufficient breakdown voltage.

Although an example of using a laminator roll for the thermocompression bonding of the transparent conductive film and the luminescent layer has been shown in this embodiment, any kind of equipment and method, such as hot press or vacuum sealer, may be employed as long as heat and pressure can be applied simultaneously.

Furthermore, the electroluminescent element 5 according to this embodiment has electrically conductive parts (the transparent conductive film and the aluminum foil) at the end parts, but these parts may be sealed with an inexpensive transparent film (for example, a PET film) to insulate them.

Next, a second embodiment of the present invention will be described. Although in the first embodiment the blocking property of the luminescent layer after formation was relaxed by specifying the weight ratio of the phosphor to the fluorinated rubber, in the second embodiment an example in which adhesion, moisture-proof property, thermal deformation and the like are improved in addition will be described.

According to the electroluminescent element 15 of the second embodiment according to the present invention a reflective insulating layer 12 in which powder of an insulator such as barium titanate is dispersed in a fluorinated resin (for example, G801 fabricated by Daikin Industrial Co., Ltd.) is formed by using continuous operation of doctor printing process on a back electrode 11 consisting of an aluminum foil or the like. Next, a luminescent layer 13 in which powder of phosphor (for example, Sylvania phosphor Type 20) obtained by moisture-proof coating phosphor particles of zinc sulfide activated with copper are dispersed in a binder which is the mixture of a fluorinated resin (for example, G801 fabricated by Daikin Industrial Co., Ltd.) which is in solid form at normal temperature and a fluorinated resin (for example, G101 fabricated by Daikin Industrial Co., Ltd.) which is in liquid form at normal temperature, is formed on the reflective insulating layer 12 by continuous operation of doctor printing process.

Finally, a transparent electrode 14 obtained by forming an ITO film on a PET film is bonded to the luminescent layer 13 by thermocompression bonding using a laminator, completing the electroluminescent element 15.

Here, the mixing weight ratio of the fluorinated resin (G101) which is in liquid form at normal temperature to the fluorinated resin (G801) which is in solid form at normal temperature for forming the binder used for the luminescent layer 13 is set to be in the range of 0.2 to 1.6, and the weight ratio of the phosphor to the fluorinated resin (mixture of the fluorinated resin in solid form at normal temperature and the fluorinated resin in liquid form at normal temperature) is set to be in the range of 1 to 10. This binder does not generate the blocking property at winding-up or taking-out even when continuous roll-to-roll printing is employed, similar to the first embodiment.

Moreover, it is possible to lower the temperature of the thermocompression bonding of the transparent electrode and the luminescent layer since the mixed resin has a low viscosity. Namely, since the mixed resin retains fluidity even in the temperature range of 70° to 200° C., by the application of a pressure, in addition, it is possible to push the mixed fluorinated resin, especially the fluorinated resin component retaining fluidity over a wide temperature range and is in liquid form at normal temperature, toward the surface of the luminescent layer 13 to form there a layer of that component of the fluorinated resin and make a wide area contact with the transparent electrode. In this way, when the resin is solidified by the cooling after the passage of the laminator roll, the resin layer can readily and firmly be bonded with the transparent conductive film, improving drastically the moisture-proof property. Moreover, since the temperature of the thermocompression bonding can be lowered to relax the expansion and compression of the members, there can be obtained advantages preventing the generation of microcracks in the ITO film and the dimensional accuracy of the electroluminescent element can be improved.

The fluorinated resin which is in solid form at normal temperature used in the present embodiment can be selected from the group consisting of polytetrafluoroethylene, vinylidene fluoride-tetrafluoroethylene copolymer, polyvinylidene fluoride, polychlorotrifluoroethylene, tetrafluoroethylene-hexafluoropropylene copolymer, polyvinylidene fluoride-hexafluoropropylene copolymer and polyvinylidene fluoride-polytetrafluoroethylenehexafluoropropylene copolymer.

Further, the fluorinated resin which is in liquid form at normal temperature used in the present embodiment includes vinylidene fluoride-tetrafluoroethylenehexafluoropropylene copolymer.

Since the bonding property can be enhanced by the addition of the fluorinated resin which is in liquid form at normal temperature, it is possible to raise the weight ratio of the phosphor to the fluorinated resin to 10 to further improve the luminance.

As a modification of this embodiment, in place of the fluorinated resin which is in solid form at normal temperature, use may be made of fluorinated rubber, a fluorinated resin which shows fluidity in high temperature range, a fluorinated resin which does not exhibit the blocking property, or the like as the binder, thus offering a diversity in the choice of the fluorinated resins. Moreover, since these fluorinated resins have a large bonding force to the transparent conductive film, it is possible to manufacture an electroluminescent element even when the charging rate of the phosphor into the binder is further increased, so that the quality of the luminescence such as the luminance itself and the unevenness in the luminance can further be improved.

What is claimed is:

1. An electroluminescent element comprising:

a back electrode;

a reflective insulating layer formed on said back electrode;

a luminescent layer formed on said reflective insulating layer, said luminescent layer including a phosphor powder dispersed in fluorinated rubber, a mixing weight ratio of said phosphor powder to said fluorinated rubber being in a range of 1:1 to 5:1; and a transparent electrode formed on said luminescent layer, said phosphor powder being located in said luminescent layer toward said insulating layer, said phosphor powder being free from contact with said transparent electrode, thereby improving adhesion between said luminescent layer and said transparent electrode;

wherein said phosphor powder is located nearer to said reflective insulating layer than is said transparent electrode.

2. The electroluminescent element of claim 1, said reflective insulating layer further comprising an insulator powder dispersed in a fluorinated rubber.

* * * * *